US006694672B1

(12) United States Patent
Hergeth

(10) Patent No.: US 6,694,672 B1
(45) Date of Patent: Feb. 24, 2004

(54) GROUND LINING, COVERING AND METHOD FOR LAYING A GREEN AREA

(75) Inventor: Willibald Hergeth, Freystaedter Strasse 16, D-92334, Berching/Erasbach (DE)

(73) Assignee: Willibald Hergeth, Berching/Erasbach (DE)

( * ) Notice: Subject to any disclaimer, the term of this patent is extended or adjusted under 35 U.S.C. 154(b) by 0 days.

(21) Appl. No.: 09/936,649

(22) PCT Filed: Mar. 2, 2000

(86) PCT No.: PCT/DE00/00649

§ 371 (c)(1),
(2), (4) Date: Feb. 12, 2002

(87) PCT Pub. No.: WO00/55429

PCT Pub. Date: Sep. 21, 2000

(30) Foreign Application Priority Data

Mar. 15, 1999 (DE) ..... 199 11 409

(51) Int. Cl.[7] ..... A01G 9/02
(52) U.S. Cl. ..... 47/65.9
(58) Field of Search ..... 47/904, 905, 2, 47/48.5, 65.9, 66, 86

(56) References Cited

U.S. PATENT DOCUMENTS 5,187,894 A * 2/1993 Ripley et al. ..... 47/86
6,263,616 B1 * 7/2001 Hummer ..... 47/65.9

FOREIGN PATENT DOCUMENTS

DE 2521374 12/1976
DE 19720006 11/1998
FR 2641668 7/1990
FR 2659996 9/1991
JP 406153685 A * 6/1994 ..... 47/48.5
JP 409074904 A * 3/1997 ..... A01G/1/12
JP 02001000051 A * 1/2001 ..... A01G/13/00
JP 02002017175 A * 1/2002 ..... A01G/13/00

* cited by examiner

*Primary Examiner*—Charles T. Jordan
*Assistant Examiner*—Francis T. Palo
(74) *Attorney, Agent, or Firm*—Davidson, Davidson & Kappel, LLC

(57) ABSTRACT

A ground lining for regulating the water balance of an area of ground has a combination of ground panels (5) which can be placed against each other and a panel covering (51) which has a number of openings (16*a, b*) to allow the passage of water. The ground lining (6) also comprises a panel base (52) which is located at a distance from the panel covering (51), several reservoirs (54) being provided between the panel base (52) and the panel covering (51). These reservoirs are separated from each other by dividing walls (53) that extend between the panel base (52) and the panel covering (51) and adjacent reservoirs (54) are interconnected by an overflow (55). According to prior art, moisture is only stored above the level of the panel in direct contact with the surface structure or the surface that is walked on. According to the invention, the reservoirs (54) that extend under the panel base (52) ensure a longer-lasting storage capacity and therefore a longer moisture supply phase to the structure above. Another ground lining is composed of a combination of rectangular ground panels (5) which are laid against each other and are delimited by peripheral side walls (56). Two side walls (56) are adjacent through a corner each have a molded-on elastic hook (8) for connecting adjacent ground panels (5).

18 Claims, 4 Drawing Sheets

GROUND LINING, COVERING AND METHOD FOR LAYING A GREEN AREA

BACKGROUND OF THE INVENTION

The present invention relates to a ground lining, a covering for creating a green area or a sports field as well as a method for laying a green area.

Ground linings for regulating the water balance of an area of ground, for example, of a sports field are disclosed in German Patent Application DE 197 20 006 A1. Described there are grid panels which are interconnectable to form a lining and which have elevations and depressions at their upper sides for storing a residual moisture. These ground linings have proven to be efficient for covering structures having a normal moisture requirement. For covering structures having an increased moisture requirement or green areas which are subject to a long dry period, increased demands are made on the regulating capability of the water balance in the ground.

A further ground lining as well as a covering for creating a riding field is described in German Patent Application DE 44 16 943 A1. The upwardly open design of the ground panels with the upwardly projecting edges of the individual hexagonal panel elements are, on one hand, sensitive to damage, in particular, when the ground panels are laid bare as part of a riding field covering. This will then also involve a risk of injury to the persons or animals stepping on the covering. Moreover, the water regulating capability of such an open structure is reduced.

The same applies to the grid panels which disclosed in the publications U.S. Pat. No. 5,816,738; DE 297 07 770 U1; DE 196 32 070 C2; EP 0 516 957 A1 und DE 44 15 595 A1 and which are partly usable for grass areas.

Also, with respect to the ability of ground linings to be laid over large surfaces, it is useful for these ground linings to be able to be quickly laid down onto the subgrade or the surface of the ground; here, increased demands are to be made on the connecting elements between the panels in terms of flexibility and strength.

In the case of ground elements having variations in temperature, it must be possible to compensate for expansions between the panels. The intention for the present invention is, moreover, to contribute to accelerate the laying of green areas even in difficult ground and climate conditions by means of a suitable method.

SUMMARY OF THE INVENTION

The present invention provides a ground lining for regulating the water balance of an area of ground comprising a combination of ground panels (5) which can be placed against each other and which feature a panel covering (51) having a plurality of cover openings (16*a, b*) to allow the passage of water, wherein the ground lining (6) features a panel base (52) which is located at a distance from the panel covering (51), several reservoirs (54) being provided between the panel base (52) and the panel covering (51) and separated from each other by dividing walls (53) that extend between the panel base (52) and the panel covering (51); and adjacent reservoirs (54) are interconnected by an overflow (55).

The present invention also provides a ground lining comprising a combination of square ground panels (5) which can be placed against each other and which are bordered by surrounding side walls (56), wherein two side walls (56) meeting at a corner each have an integrally molded hook (8) for connecting adjacent ground panels (5) and the remaining two side walls (56) feature pockets (81) for the engagement of the hooks (8).

A covering of a sports field or of a green area is also provided, the covering comprising a subgrade (1) and an overlaying surface structure (2) featuring at least one walked-on layer (7), wherein a ground lining (6) is arranged between the walked-on layer (7) and the subgrade (1). A method for laying a green area is provided, comprising the following method steps: construction of the covering; the ground lining (6), which is filled with a substrate which promotes the growth of grass or with liquid, being laid prior to placing the walked-on layer (7); applying the walked-on layer (7), sprinkling grass seeds over the walked-on layer (7), and watering the walked-on layer (7).

The regulation of the water balance within the structure of the covering is essential for the lasting preservation of green areas such a grass area, sports fields, etc. To minimize the cost intensive artificial irrigation outlay, especially during dry periods or in climatically unfavorable regions of the earth, the present invention makes provision for reservoirs for storing water to be integrated in the ground panel. While in the related art, provision is made for the moisture to be stored only above the panel plane, in direct contact with the overlaying surface structure or the layer that is walked on, the reservoirs that extend underneath the panel base ensure a longer-lasting storage capacity and therefore a longer moisture supply phase to the structure above. It is important for this that the reservoirs be configured inside the ground panel in a closed manner, that is without direct contact to the overlaying covering structure. The overflows between the reservoirs ensure that a locally increased accumulation of water can be distributed over the adjacent reservoirs so that a homogeneous water regulating capability is provided in the cover or ground lining. By an additional profiling of the panel covering, for example with elevations and depressions, it is possible, on one hand, to influence the regulating capability additionally and, on the other hand, to increase the stiffness of the ground lining, which is advantageous in the case of compressive loading of the lining. The adhesion and interconnection with the adjacent layer is increased as well.

It is to be regarded as a further advantage that, using the surface contour of the ground panels constituted by the elevations and depressions, it was possible to find a surface contour which counteracts the flow behavior of the walked-on layer and which not only prevents the walked-on layer from being laterally displaced between the elevations within the walked-on layer but which also suppresses a lateral displacement above the elevations in an effective manner. This effect is based on that fact that a local compressive load gives rise to a conical pressure distribution in the walked-on layer which is largely compensated for due to the surface of the ground panels which is structured by elevations. This compensation effect is intensified by the wall of the elevations which is slanted in design and generally has a conical or pyramidal shape so that, in response to the pressure, for example of a horse's hoof, an oppositely directed pressure distribution develops in the walked-on layer. This pressure distribution counteracts the conical pressure shape resulting from the horse's hoof. Thus, the horizontal pressure component underneath the horse's hoof is largely neutralized and a lateral spreading of the walked-on layer (sand) above the elevations is effectively prevented. In a further embodiment of the present invention, the elevations are staggered by rows so as to hinder the walked-on layer from flowing along the troughs. Such an arrangement ensues also in a chessboard-like arrangement of the elevations when, in lieu of a trough crossing, an elevation is located between four adjacent elevations. These second elevations can then have a different design than the aforementioned first elevations. The second elevations could be designed, for example, without depression or smaller.

Should the ground panels nevertheless be locally cleared of the walked-on layer, then the surface structure turns out to be largely insensitive to impact effects since the elevations are always designed to have a larger surface than a web-like partitioning of the surface. Therefore, damage to the ground panels by an external influence and a resulting risk of injury are not to be expected.

A further advantage of the ground lining consists in the flexible design of the ground panels which ensues from the waved structure of the successive elevations and troughs. Advantageous is also the flexibility of the panel perpendicularly to the panel plane. A loading of the ground panel gives rise to a local plunging of the elevations into unfilled hollow spaces underneath the ground panel, enabling the flexibility. The elasticity of the ground lining resulting from this ensures unvarying ground conditions over a large surface.

The design of the ground lining according to the present invention makes it suitable for coverings of any kind so that the ground lining is also suitable for driveways and walkways as well as for storage areas in warehouses where it is directly contacted.

By forming hooks on the edges of the ground panels on both sides of a corner, it is possible to form a large-surface interconnected ground lining which can also be wound onto and unwound from a mandrel so that a rapid laying of large-surface ground linings is possible. The U-shaped design of the hooks permits the flexibility required during the winding up and unwinding of the lining, i.e., of the panels.

Because of the capability of filling the reservoirs in the ground panels also with substrates which promote ground or green area growth, it is possible to accelerate the creation of a green area by laying ground panels which are filled in this manner.

BRIEF DESCRIPTION OF THE DRAWINGS

Advantageous embodiments of the present invention will be explained in the following with reference to the attached drawing.

DETAILED DESCRIPTION

Figure 1:
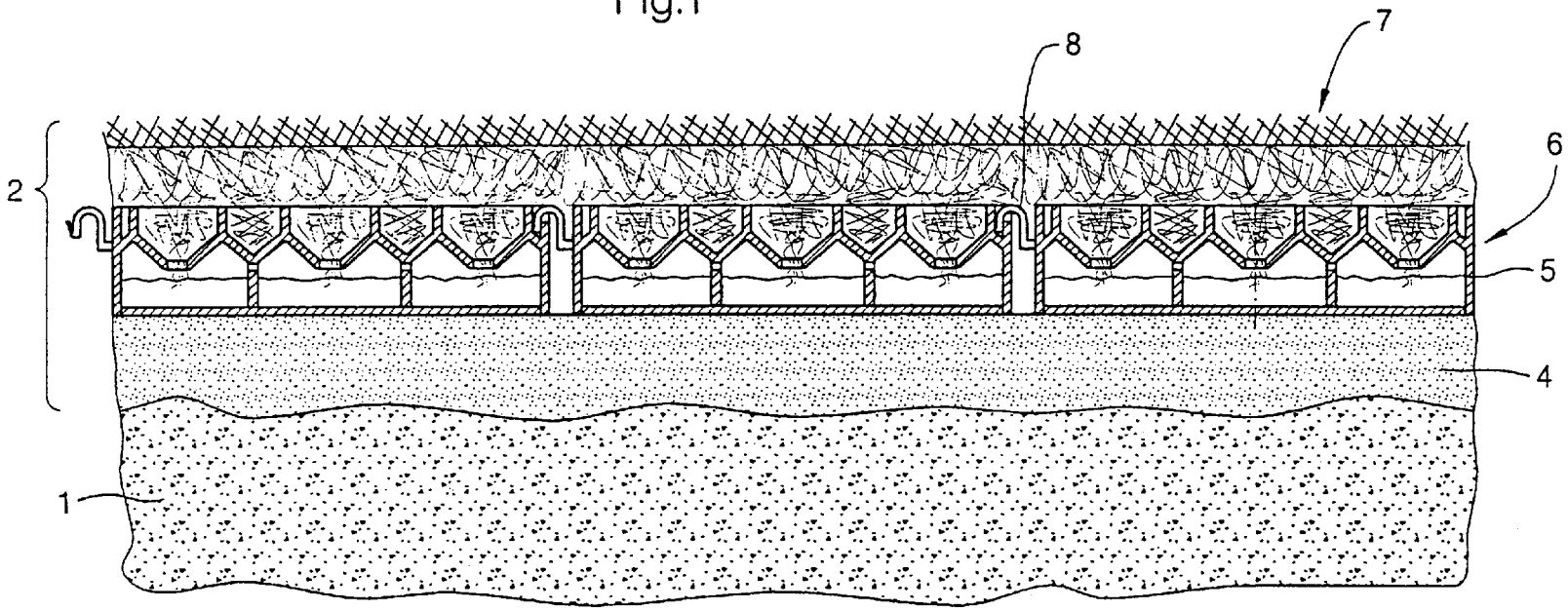
FIG. 1 shows a schematic cross-section of a green field covering with ground panels.

The covering of a lawn for a golf course as shown in a sectional view in FIG. 1 is composed of a subgrade 1 and an overlaying surface structure 2. Subgrade 1 can be a foundation of gravel, grass, loam, sand or humus. If necessary, the subgrade is leveled to eliminate rough unevennesses so as to prepare it for surface structure 2. Subsequently, the individual layers of surface structure 2 are placed onto the so prepared subgrade 1. Surface structure 2 is composed, in an upward direction, of a lower sand layer 4, of a ground lining 6 composed of ground panels 5, and of a walked-on layer 7 composed of grass and humus. Ground panels 5 are manufactured from thermoplastic material, recycled material being used as well.

As is further discernible in FIG. 1, ground lining 6 is composed of a plurality of interconnected ground panels 5, the connection of adjacent ground panels 5 being effected via several flexible hooks 8. Due to the elastic connection of ground panels 5, it is first of all possible for ground lining 6 to conform to unevennesses stemming from the subgrade without giving rise to gaps between ground panels 5. In this manner, it is also ensured that ground panels 5 cannot be driven apart by an external influence.

Figure 2A:
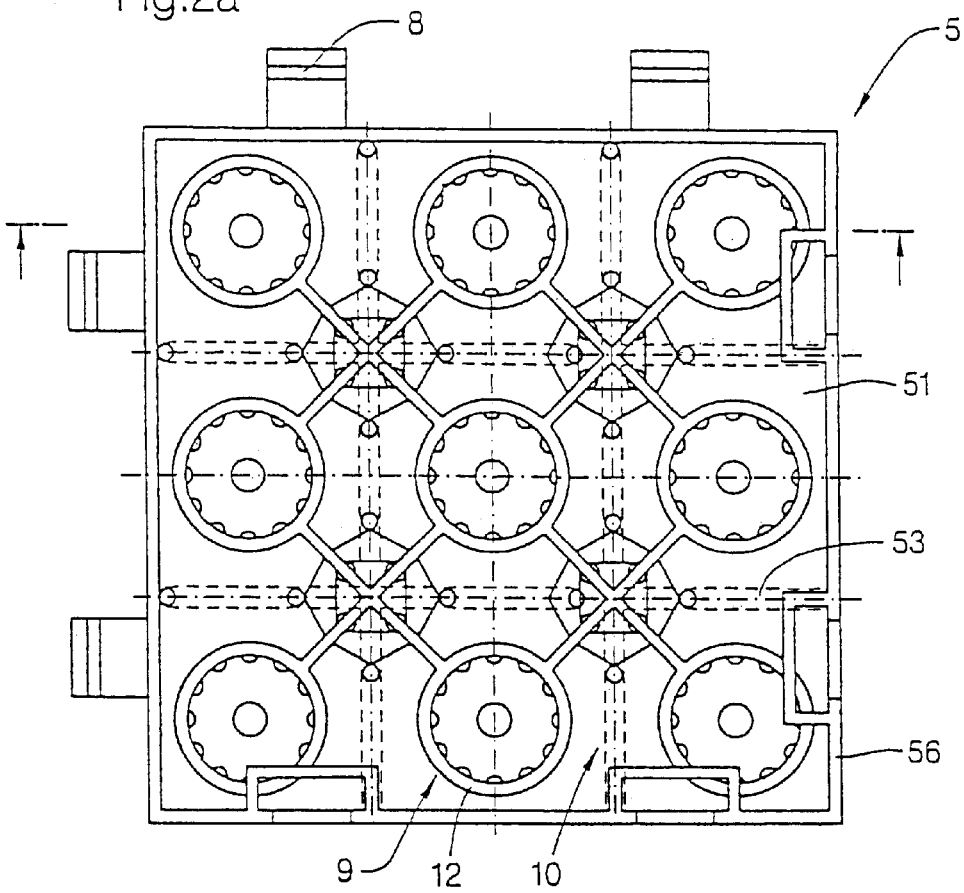
FIG. 2*a* is a top view of the ground panel according to FIG. 1.

In terms of the geometric layout of ground panels 5, they are advantageously configured as a regular polygon, the exemplary embodiments according to FIGS. 1, 2*a,* 2*b,* 3 and 5 depicting ground panels 5 having a square layout.

The side length of 200 or 250 millimeters chosen for the exemplary embodiments according to FIGS. 2*a, b* and 5 allows ground lining 6 to be unwound in sheets so as to allow a rapid laying of ground lining 6.

Figure 2B:
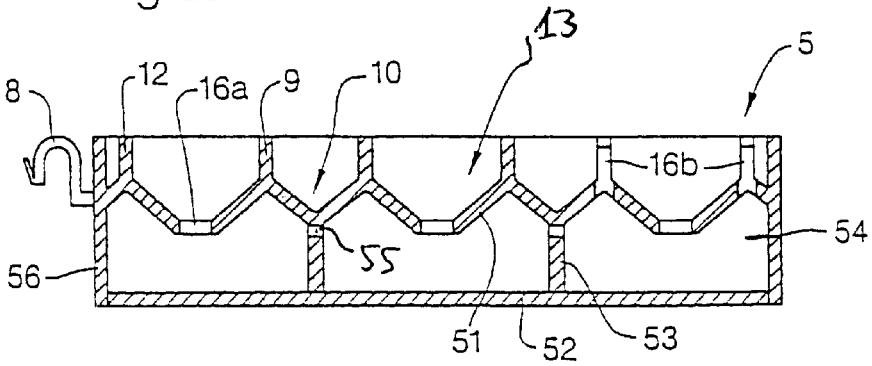
FIG. 2*b* shows a cross-section of the ground panel according to FIG. 2*a;*

As can be gathered from FIGS. 2*a* and 2*b,* ground panel 5 is constituted by a panel covering 51 and a panel base 52 which are spaced from each other by vertically extending dividing walls 53. As shown in broken lines in FIG. 2*a,* dividing walls 53 run in the form of a grid, thus dividing the hollow space of the ground panel into reservoirs 54 lying side-by-side in a chessboard-like manner.

Adjacent reservoirs 54 are interconnected via overflows 55 so that it is possible for water to enter the reservoirs via cover openings 16*a* and 16*b* provided in panel covering 51, and to distribute uniformly over reservoirs 54.

In case that ground panel 51 is located in an inclined position on a slope, the water can be retained in an uphill direction as well. To this end, overflows 55 are formed in dividing walls 53 near panel covering 51. Overflows 55 are designed as wall apertures.

As is further discernible in FIGS. 2*a* and 2*b,* ground panel 5 is encircled by a surrounding side wall 56 whose edges extend beyond panel covering 51. The edges terminate level with elevations 9 formed in panel covering 51.

FIGS. 2*a* and 2*b* depict, moreover, the profiling of panel covering 51. Each ground panel features pyramidally-shaped elevations 9 which are formed on panel covering 51 in a chessboard-like manner, each panel covering 51 being divided into nine equally sized square fields according to the arrangement of reservoirs 54, the square fields each having a centrically arranged elevation 9. Troughs 10, which are V-shaped in cross-section, extend between elevations 9. Elevations 9, which are similar to the frustum of a pyramid, terminate in an upward direction in an annular edge, the so-called "crater edge" 12. The contour of the elevation ensues from the combination of a pyramidally-shaped base which merges continuously up to annular crater edge 12 into a conical shape; from there on, crater edge 12 extends vertically upward. A crater-shaped depression 13, which originates at crater edge 12, extends centrically into the interior of each elevation 9.

To support the regulation of the water balance, crater edges 12 are provided with cover openings 16*b* so that it is possible for water from troughs 10 to flow off into subgrade 1 via the cover openings of crater edge 12 as soon as it reaches the crater edge. Cover openings 16*b* of crater edges 12 are designed as bore holes which extend vertically into the crater edge and whose diameter is larger than the wall thickness of the crater edges so that slot-shaped cover openings 16*b* extend from the base of the edges. Water flowing into depression 13 flows off via cover openings 16*a* which are centrically formed in depression 13.

Panel covering 51, dividing walls 53 as well as side walls 56 are manufactured separately from panel base 52 using the injection molding or deep drawing method.

Figure 3:
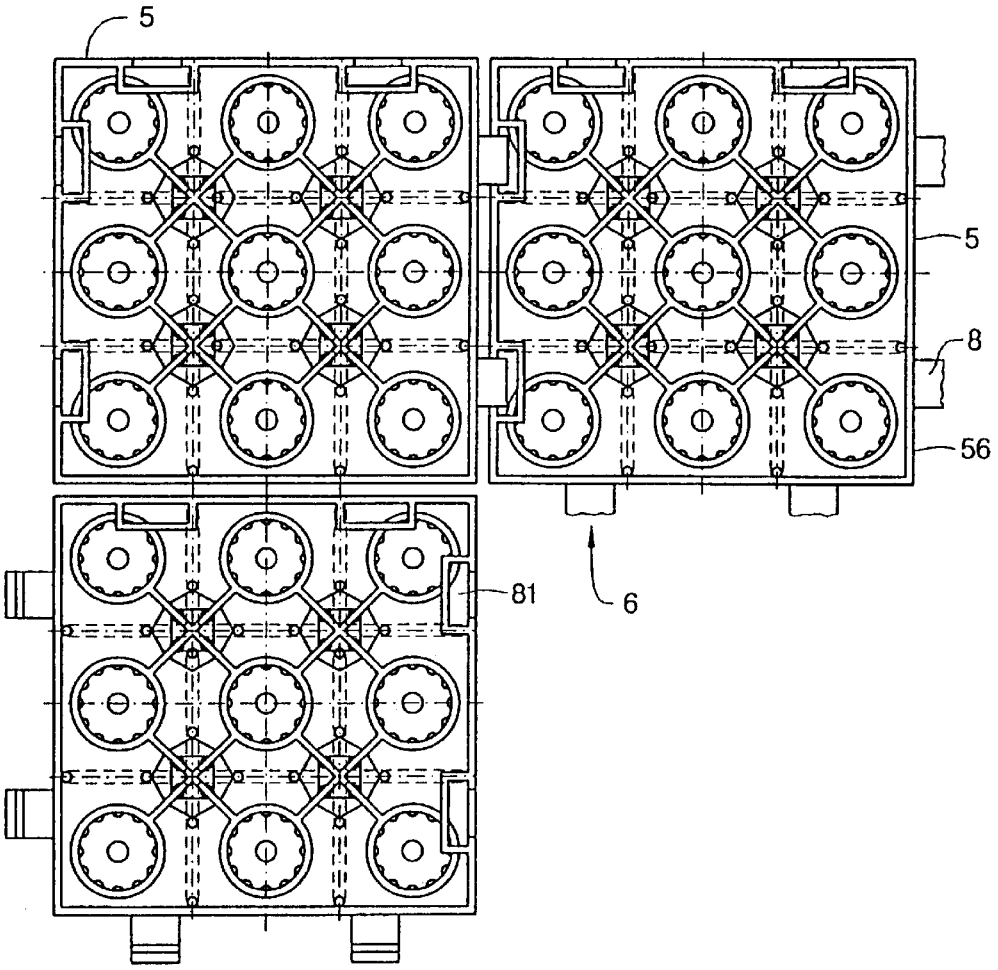
FIG. 3 is a top view of a ground lining composed of interconnected ground panels.

A combination of several ground panels 5 is depicted in FIG. 3. Using two hooks 8 which are in each case formed on two side walls 56 meeting at a corner, adjacent ground panels 5 are connected to form a ground lining 6. In the other two side walls, provision is made in each case for pockets 81 for the engagement of hooks 8. Hooks 8 are formed on side walls 56, which can be carried out integrally in the case of injection-molded parts.

Ground panels 5 of adjacent rows are arranged without offset from each other, that is in a chessboard-like manner so that it is possible for a ground lining 6 to be wound up on a mandrel and, consequently, to be quickly unwound for laying. Arched hooks 8 ensure the flexibility between the ground panels which is required for this so that an elastic flexibility of ground panels 5 relative to each other is made possible, in particular in the panel plane, as is discernible in FIGS. 1 and 3. Tensions which can develop in the ground panels due to irregularities of the underlying ground can thus be considerably reduced.

Figure 4A:
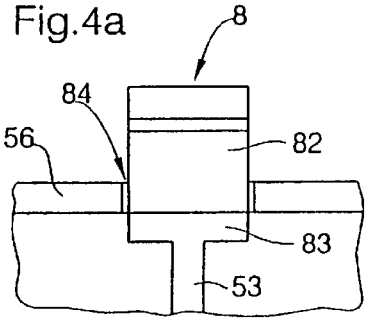
FIG. 4*a* shows a cut-away portion of a ground panel including a hook.
Figure 4B:
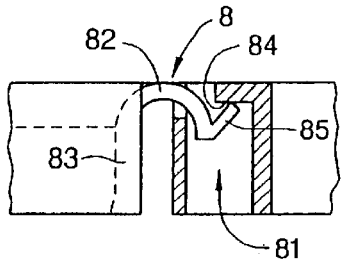
FIG. 4*b* is a view of two ground panels which are interconnected via hooks.

FIGS. 4*a* and 4*b* depict hooks 8 for the elastic connection of adjacent ground panels 5.

Hooks 8 have a U-shaped or arched section 82; a leg 83, which is formed at a distance from side wall 56, being arranged parallel to side wall 56. In the region of hook 8, side wall 56 has a cut-out 84 which hook 8 extends into. Leg 83 is joined to adjacent dividing wall 53 in a T-shaped manner, which prevents hook 8 from bulging or even tearing off from side wall 56 under load. Provided at the free end of hook 8 is a tongue 85 which has a flexible design and which, during the engagement of hook 8 with pocket 81 of adjacent ground panel 5, elastically snaps into an undercut 84 formed by the pocket. Thus, for inserting hook 8 into cut-out 84 of the adjacent ground panel, it is inserted into the cut-out from above essentially perpendicularly to the panel plane. Consequently, the flexibility of this connection runs essentially perpendicularly to the direction of engagement of hook 8, which, on one hand, prevents hook 8 from slipping out under stress and, on the other hand, supports the elastic flexibility in the panel direction.

Figure 5:
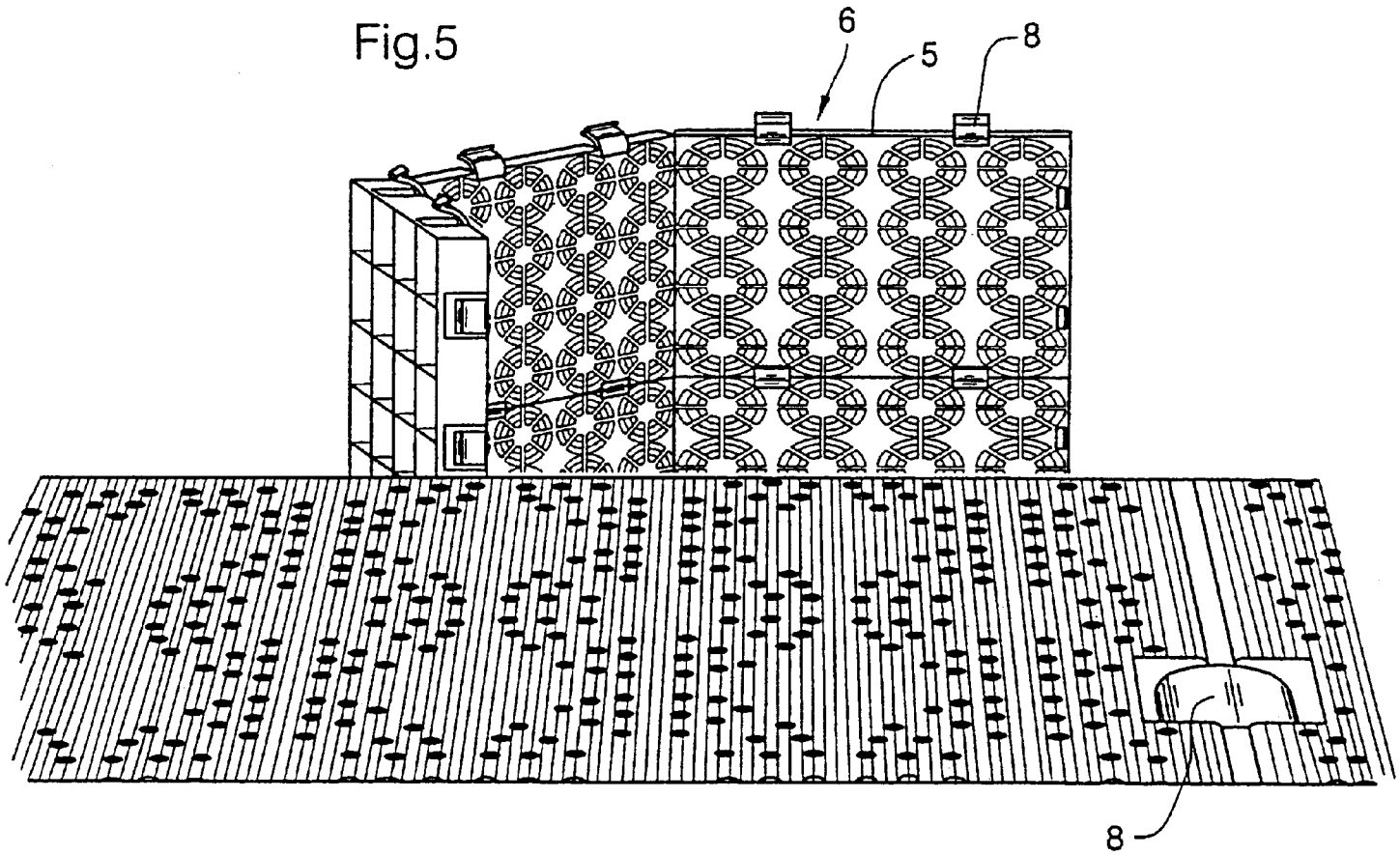
FIG. 5 is a perspective representation of a ground panel.

FIG. 5 shows an alternative embodiment of a ground panel 5 without elevations and without panel base. Hooks 8 terminate level with the surface of the ground panel which is provided with numerous openings for the passage of water and/or light. Ground panel 5 is suitable for being laid as a superficial ground lining, on one hand, for reinforcing the ground and, on the other hand, to protect it from damage from being intensively walked or traveled on. The connection of the ground panels via the above described hooks 8, makes it possible for the ground lining to be wound up and unwound.

LIST OF REFERENCE SYMBOLS

| | |
|---|---|
| 1 | Subgrade |
| 2 | Surface structure |
| 4 | Sand layer |
| 5 | Ground panel |
| 51 | Panel covering |
| 52 | Panel base |
| 53 | Dividing wall |
| 54 | Reservoir |
| 55 | Overflow |
| 56 | Side wall |
| 6 | Ground lining |
| 7 | Walked-on layer |
| 8 | Hook |
| 81 | Pocket |
| 82 | Section |
| 83 | Leg |
| 84 | Cut-out |
| 85 | Tongue |
| 9 | Elevation |
| 10 | Trough |
| 12 | Crater edge |
| 13 | Depression |
| 16a, b | Cover opening |

What is claimed is:

1. A ground panel for regulating water in an area of ground comprising:

a panel covering having a plurality of cover openings to allow the passage of water; and a panel base being located at a distance from the panel covering so as to define a first reservoir and an adjacent reservoir between the panel base and the panel covering, the first reservoir being separated from the adjacent reservoir by at least one dividing wall extending between the panel base and the panel covering, the first reservoir and the adjacent reservoir being interconnected by an overflow, wherein the panel covering includes at least one of elevations and depressions spaced from each other by troughs, the elevations defining the depressions, the depressions being crater-shaped.

2. The ground panel as recited in claim 1, wherein the first reservoir and the adjacent reservoir are two of a plurality of reservoirs, the plurality of reservoirs being arranged side-by-side in a chessboard-like manner.

3. The ground panel as recited in claim 2 wherein the plurality of reservoirs numbers between four or nine reservoirs.

4. The ground panel as recited in claim 1 wherein the overflow is formed by an aperture in the at least one dividing wall.

5. The ground panel as recited in claim 1 further comprising a surrounding side wall surrounding the panel, the side wall having edges extending beyond the panel covering.

6. The ground panel as recited in claim 1 wherein at least one of the troughs, the depressions and edges of the elevations include at least one cover opening for accessing the first reservoir.

7. The ground panel as recited in claim 1 wherein at least one of a single elevation and single depression in the panel covering covers the first reservoir.

8. The ground panel as recited in claim 1 wherein the elevations each have an annular edge, the edges terminating level with a side wall edge of the panel.

9. The ground panel as recited in claim 1 wherein annular edges of the elevations have cover openings formed by bore holes whose diameter is larger than a wall thickness of the edge.

10. The ground panel as recited in claim 1 wherein the panel covering, the at least one dividing wall and a side wall bordering the ground panel are formed from an injection-molded or deep-drawn part separate from the panel base.

11. The ground panel as recited in claim 1 wherein the panel base is filled with a fertilizer.

12. A ground lining comprising a plurality of combined ground panels as recited in claim 1.

13. The ground lining as recited in claim 12 wherein the ground panels are rectangular and further include surrounding side walls, two side walls of a first ground panel meeting at a corner, with each of the two side walls having an integrally molded hook for connecting adjacent ground panels, the first ground panel having two remaining side walls including pockets for the engagement of hooks of other ground panels.

14. The ground lining as recited in claim 13 wherein the hook has a U-shaped section, a leg arranged parallel to one of the side walls, the leg being transversely joined to the side wall at a lateral distance therefrom.

15. The ground lining as recited in claim 14 wherein in the region of the hook, the respective side wall has a cut-out into which the hook extends, a leg being joined to a web which projects vertically from the panel covering.

16. The ground lining as recited in claim 12 wherein the hook has a tongue at its free end, the tongue having a flexible design and elastically snappable into an undercut during the engagement of the hook with a pocket.

17. A covering of a sports field or of a green area comprising:

a subgrade;

an overlaying surface structure having at least one walked-on layer; and a ground lining as recited in claim 12 arranged between the walked-on layer and the subgrade.

18. A method for laying a green area, comprising the steps of:

constructing the covering as recited in claim 17, the covering including a fertilizer;

applying the walked-on layer after laying the covering;

sprinkling grass seeds over the walked-on layer; and watering the walked-on layer.

* * * * *